United States Patent [19]

Studer et al.

[11] Patent Number: 5,038,955

[45] Date of Patent: Aug. 13, 1991

[54] PAINTBRUSH CADDY

[75] Inventors: Lewis O. Studer, Barberton; Ernest P. Hornak, North Lawrence, both of Ohio

[73] Assignee: Kaddi Corporation, North Lawrence, Ohio

[21] Appl. No.: 636,895

[22] Filed: Jan. 2, 1991

[51] Int. Cl.[5] ..... B44D 3/12; B65D 25/00

[52] U.S. Cl. ..... 220/90; 15/257.06; 206/361; 248/110

[58] Field of Search ..... 15/257, 257.05, 257.06; 220/85 D, 90; 206/361; 248/110, 111

[56] References Cited

U.S. PATENT DOCUMENTS

| | | | |
|---|---|---|---|
| 2,676,730 | 4/1954 | Hedglon | 220/90 |
| 3,275,187 | 9/1966 | Lamoureaux | 220/90 |
| 3,948,413 | 4/1976 | Gorrell et al. | 15/257.06 |
| 4,266,746 | 5/1981 | Klaiber | 15/257 R |
| 4,275,818 | 6/1981 | Church | 15/257.05 |
| 4,491,234 | 1/1985 | Wilcock | 220/90 |
| 4,561,556 | 12/1985 | Bendix | 206/361 |
| 4,751,763 | 6/1988 | Rose et al. | 206/361 |
| 4,854,470 | 8/1989 | Ireland | 206/361 |
| 4,865,282 | 9/1989 | Yonkman | 15/257.06 |
| 4,949,864 | 8/1990 | La Kier | 15/257.05 |

FOREIGN PATENT DOCUMENTS

| | | | |
|---|---|---|---|
| 2160093 | 12/1985 | United Kingdom | 15/257 R |

*Primary Examiner*—Jimmy G. Foster
*Attorney, Agent, or Firm*—Renner, Kenner, Greive, Bobak, Taylor & Weber

[57] ABSTRACT

A paintbrush caddy (50 or 150) embodying the concepts of the present invention utilizes a shelf plate (54,154) having a longitudinal length sufficient for supporting a paintbrush (80) thereon. The forward end portion of the shelf plate (54,154) may be affixed to a vertically depending apron (52,152) positioned at an obtuse angle ($\alpha_1$) relative to the shelf plate (54,154) such that a paintbrush (80) supported on the upper surface of the shelf plate (54,154) is positioned at an acute angle ($\alpha_2$) with respect to a horizontal reference when the caddy (50,150) is used. An upwardly extending stop plate (60,160) is also affixed to the shelf plate (54,154) at its forward end portion, and the stop plate (60,160) is penetrated by at least one drain aperture (66,166) that opens through the stop plate (60,160) at the level of the upper surface (**54*a*,154*a*) on the shelf plate (54,154). The disposition of the shelf plate (54,154) and the stop plate (60,160) define a receptacle (62,162), and the bristle portion (84) of the paintbrush (80) is received within the receptacle (62,162). A clamping means (70,90,170) is secured to either the under surface (54*b*) of the shelf plate (54) or the rear surface (152*a*) of the apron (152), and the clamping means (70,90,170) is of such width (w) that a portion of a paint container (12) can be grasped between the clamping means (70,90,170) and the apron (52,152) to stabilize the caddy 950,150) relative to the paint container (12). The clamping means (70,90,170) thereby allows the brush caddy (50,150) to be presented in such a way as to position the paintbrush (80) for ready access when needed and for providing paint drainage from the brush, along the upper surface (54*a*,154*a*) of the shelf plate (54,154) through the drain apertures (66,166) downwardly over the apron (52,152) and into the paint container (12**).

12 Claims, 3 Drawing Sheets

FIG.-1
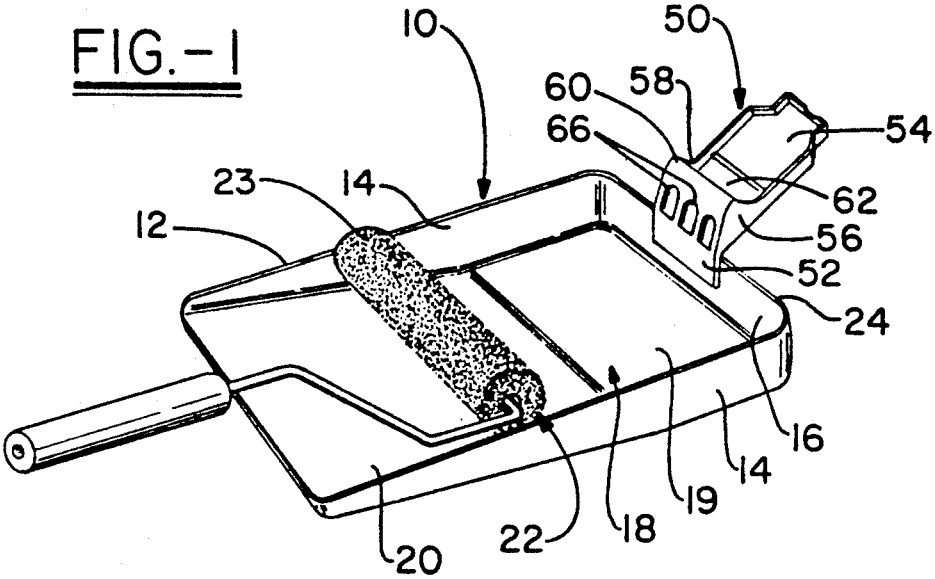
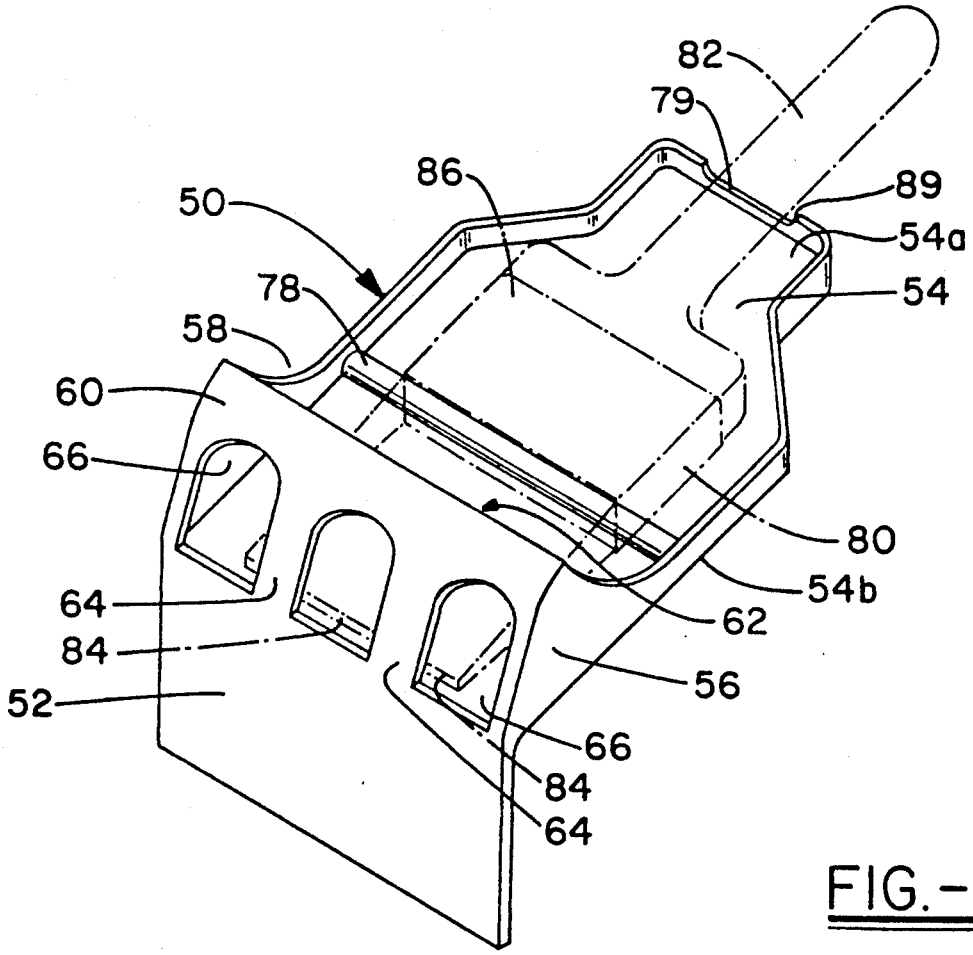
FIG.-2

FIG.-3
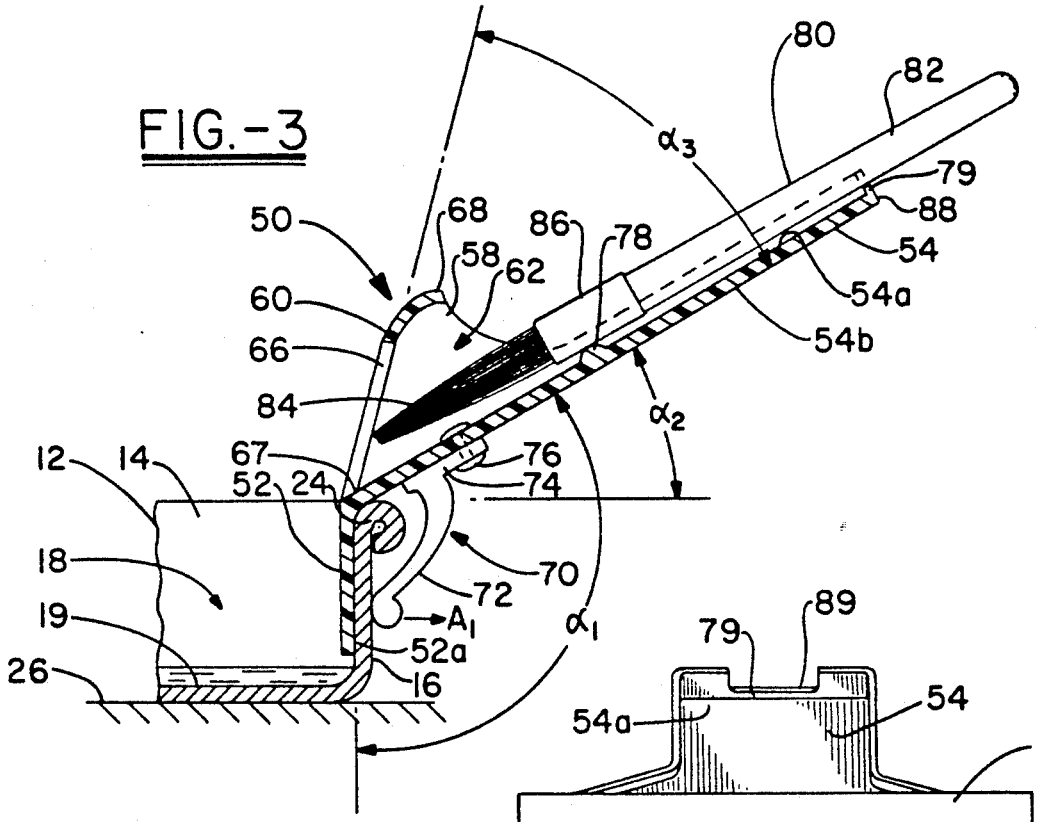
FIG.-4
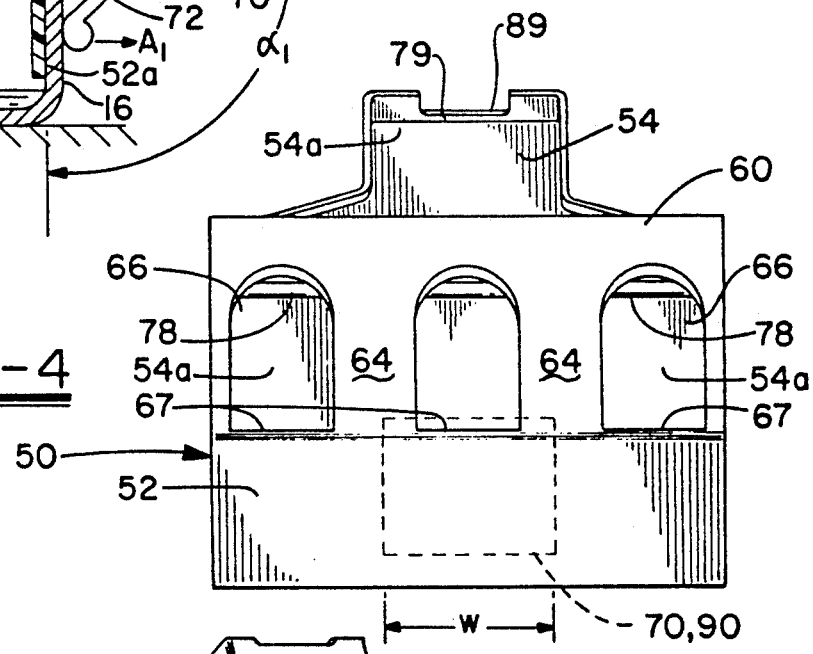
FIG.-5
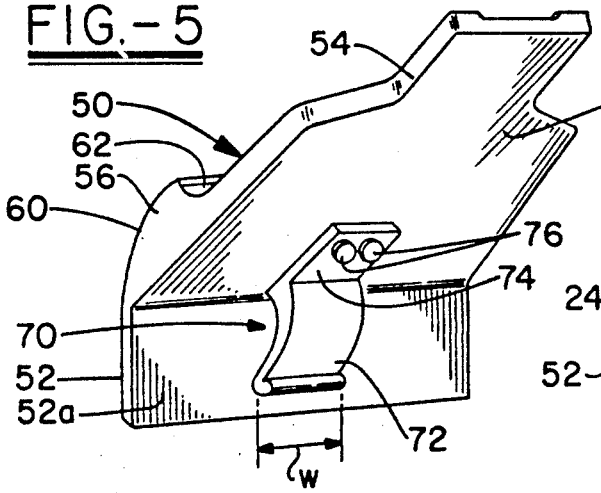
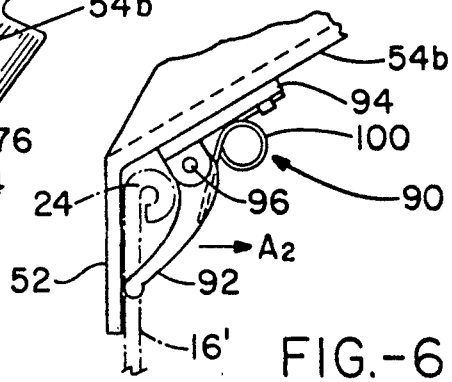
FIG.-6

PAINTBRUSH CADDY

TECHNICAL FIELD

The present invention relates generally to painting paraphernalia. More particularly, the present invention relates to a device which facilitates the temporary stowage of a paintbrush when it is being used in conjunction with other paint applying devices. Specifically, the present invention relates to a paintbrush caddy which is readily attachable to various type paint trays, or containers, to facilitate holding the brush in an orientation, and at a location, such that the brush is easily accessible to the painter when needed while also assuring that any excess paint contained within the bristles of the brush will drain out of the bristles and back into the paint tray, or container.

BACKGROUND OF THE INVENTION

When one is painting expansive areas such as the walls of a room and the like, various type painting apparatus are available which facilitate covering as much area as possible in as short a period of time as possible while still maintaining control not only over the quality of the finished job but also over the quantity of paint being applied. For example, spraying and rolling equipment are available, but these types of paint applying apparatus do not lend themselves well to the application of paint adjacent to fixtures, wall moldings and intersecting surfaces that are to receive a different color paint, or even a different finish. In order to apply paint in as close proximity as possible to fixtures, moldings and other surfaces, but without getting paint on them, one must still resort to the conventional paintbrush.

Because of the need to use a paintbrush for such "cutting in" along intersecting edges, or around fixtures, the painter only requires intermittent usage of a paintbrush. As such, a problem exists as to where the paintbrush may be temporarily stowed when the other painting equipment is being used so as to have the paintbrush readily accessible when needed. This is a particularly important requirement when a painter is working from a ladder and/or scaffolding where space is at a premium. In such circumstances, the painter has heretofore been required to descend from the ladder, or the like, to retrieve a paintbrush, use it for the brief period of time required to "cut in", and then descend again to place it in temporary stowage until the next time it is needed.

In an attempt to obviate this inconvenience some painters have been known to lay the brush on the inclined surface of the paint tray, or lean the brush against one of the side walls with the bristles resting in the paint and with the handle resting precariously against one of the side walls of the tray. At best the bristles tend to bend throughout the period that the brush is not being used, they tend to absorb too much paint and the handle, or at least the ferrule, will more likely than not slide into the reservoir of paint contained within the tray.

SUMMARY OF THE INVENTION

It is, therefore, a primary object of the present invention to provide a paintbrush caddy which facilitates the temporary stowage of a paintbrush.

It is another object of the present invention to provide a paintbrush caddy, as above, which places the brush in a location where it is readily accessible for use by the painter.

It is a further object of the present invention to provide a paintbrush caddy, as above, which allows excess paint contained within the bristles of the brush to drain back into the paint container.

It is still another object of the present invention to provide a paintbrush caddy, as above, which may be fabricated from a wide variety of materials for a low-cost brush stowage device that is readily usable in conjunction with most of the wide variety of trays, or paint containers, currently available on the market.

These and other objects of the invention, as well as the advantages thereof over existing and prior art forms, which will be apparent in view of the following detailed specification, are accomplished by means hereinafter described and claimed.

In general, a paintbrush caddy embodying the concepts of the present invention utilizes a shelf plate having a longitudinal length sufficient for supporting a paintbrush thereon. The forward end portion of the shelf plate may be affixed to a vertically depending apron positioned at an obtuse angle relative to the shelf plate such that a paintbrush supported on the upper surface of the shelf plate is positioned at an acute angle with respect to, and above, a horizontal reference when the caddy is being used. An upwardly extending stop plate is also affixed to the shelf plate at its forward end portion, and the stop plate is penetrated by at least one drain aperture that opens through the stop plate at the level of the upper surface on the shelf plate.

The disposition of the shelf plate and the stop plate define a receptacle, or cavity, therebetween, and the bristle portion of the paintbrush is received within that receptacle.

A clamping means is presented from one of the under surfaces of the caddy, and the clamping means is of such dimensions that a portion of a paint container can be grasped thereby to assure stability of the caddy relative to the paint container. The clamping means thereby allows the brush caddy to be disposed in such a way as to position the paintbrush for ready access when needed and at the same time to assure that paint will drain from the brush, along the upper surface of the shelf plate, through the drain apertures, downwardly over the apron and into the paint container.

The present invention is described in conjunction with two representative embodiments of a paintbrush caddy embodying the concepts of the present invention, and three variations of a clamping means. These embodiments, and the stated variations thereof, are deemed sufficient to effect a full disclosure of the subject invention. The exemplary paintbrush caddies are described in detail without attempting to show all of the various forms and modifications in which the invention might be embodied; the invention being measured by the appended claims and not by the details of the specification.

BRIEF DESCRIPTION OF THE DRAWINGS

FIG. 1 is a perspective view illustrating a representative paintbrush caddy embodying the concepts of the present invention as it might be used in combination with a paint tray of the type typically used with paint rollers.

FIG. 2 is an enlarged perspective view of the paintbrush caddy depicted in the combination depicted in FIG. 1;

FIG. 3 is a sagittal cross sectional view of the paintbrush caddy depicted in FIGS. 1 and 2;

FIG. 4 is an end elevational view taken from the front of the paintbrush caddy depicted in the previous figures;

FIG. 5 is a rear perspective view of the paintbrush caddy depicted in the previous figures;

FIG. 6 is a partial side elevational view depicting an alternative form of a clamping means that may be employed by the paintbrush caddy; and, FIG. 7 is an exploded perspective of an alternative embodiment of a paintbrush caddy incorporating the concepts of the present invention.

DESCRIPTION OF AN EXEMPLARY EMBODIMENT

Figure 7:
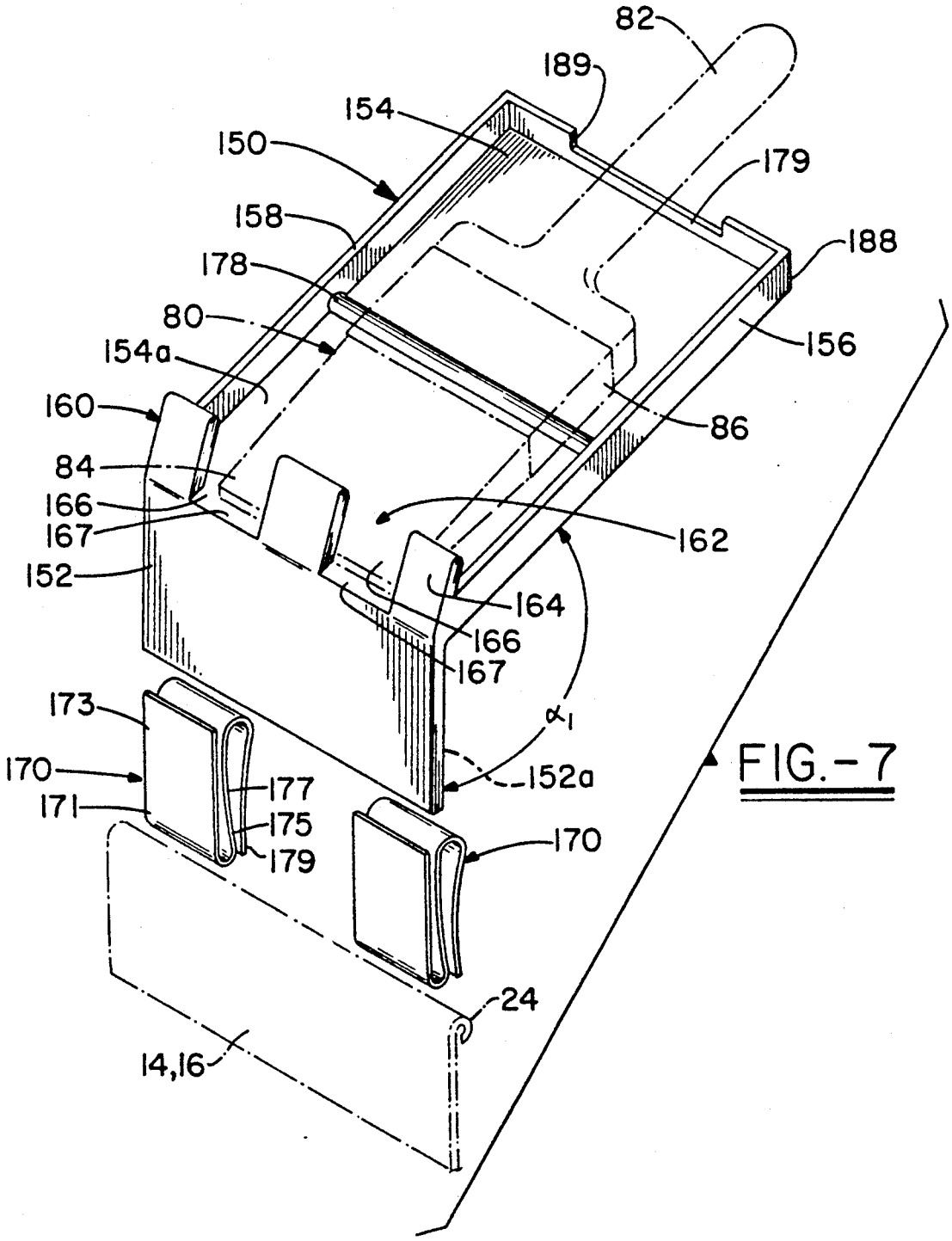

One representative form of a combined paint tray and paintbrush caddy embodying the concepts of the present invention is designated generally by the numeral 10 on the accompanying drawings. With particular reference to FIG. 1, the representative paintbrush caddy 50 is depicted as being used in conjunction with a paint tray 12 of the type conventionally known, and recognized for use with roller brushes. The tray 12 has laterally spaced, virtually identical, side walls 14 and at least one end wall 16. The two side walls 14 and the end wall 16 define a paint holding well 18 at that end of the tray 12 adjacent the end wall 16.

Paint trays 12 are generally configured such that the bottom surface 19 of the well 18 will lie parallel with, or even rest upon, the surface 26 (FIG. 3) by which the paint tray 12 is supported when in use. The tray 12 is further characterized by a sloping ramp 20 which gives direct access to the well 18 when a painter desires to apply paint from within the well 18 to a paint roller 22 in a well known manner.

The ramp 20 also functions to allow the painter to control the quantity of paint being carried on the roller 22 by rolling it along the ramp 20 not only to distribute the paint around the surface 23 of the roller 22 but also to expel any excess paint before applying the roller to a surface to be painted. The excess paint expelled from the roller 22 onto the ramp 20 will drain back into the well 18.

The upper edge on each wall 14 and 16 of the tray 12 is generally provided with a roll crimp 24 (FIG. 3) to strengthen the tray 12, and the roll crimp 24 may, as is hereinafter more fully explained, be used to enhance the engagement between the caddy 50 and the tray 12, or at least minimize inadvertent removal of the caddy 50 from the tray 12.

The front of the caddy 50 presents an apron 52 that extends downwardly from the forward end of a shelf plate 54. The shelf plate 54 itself extends rearwardly from the apron 52 for a distance sufficient to support a standard length paintbrush 80, but the shelf plate 54 preferably terminates short of the length of a standard paintbrush. In this way, a paintbrush 80 carried by the caddy 50 will have its handle 82 extend beyond the distal edge 88 of the shelf plate 54 such that a painter may easily grab the handle 82 without any interference from any part of the caddy 50.

The apron 52 merges with a stop plate 60 which extends above the upper surface **54*a* of the shelf plate 54 and may be connected to the lateral edge portions of the shelf plate 54 by virtue of a pair of side walls 56 and 58. The combination of the shelf plate 54, the stop plate 60, and the side walls 56 and 58 in the embodiment depicted in FIGS. 1–6 define a rearwardly opening receptacle, or cavity, 62 into which a paintbrush 80** may be inserted for temporary stowage.

The stop plate 60 at the forward portion of the caddy 50 is penetrated by a plurality of drain apertures 66 which extend through the stop plate 60 to communicate with the receptacle 62. The base 67 of each drain aperture 66 is disposed at the same level as the upper surface **54*a* of the shelf plate 54. As illustrated in FIG. 2, the bristles 84 of the paintbrush 80 are received within the receptacle 62 and are confined therein by the vertical grill portions 64 of the stop plate 60, the grill portions 64 being disposed between the laterally spaced drain apertures 66**.

Referring more particularly to FIG. 3, the apron 52 is disposed at a substantially obtuse angle $\alpha_1$ with respect to the shelf plate 54. This results in the shelf plate 54 being positioned at an acute angle $\alpha_2$ with respect to a horizontal frame of reference, which will normally be parallel to the surface 26 upon which the paint tray 12 will rest when it is being used. Accordingly, when a paintbrush 80 is inserted into the receptacle 62, the bristles 84 will be inclined downwardly toward the forward end of the receptacle 62. In this orientation any excess paint contained within the bristles 84 of the brush 80 will flow, via gravity, along the upper surface **54*a* of the shelf plate 54, through the drain apertures 66 and downwardly along the apron 52 and thereafter into the well 18 of the paint tray 12**.

To further facilitate paint drainage from the paintbrush 80 as well as to tend to preclude the paint from flowing toward the handle 82 of the brush 80, even when the caddy 50 is being moved, the shelf plate 54 may present a first, raised rib 78 which extends medially across the width of the shelf plate 54. The rib 78 may be formed as part of the shelf plate 54, and it is preferably positioned at a point along the length of the shelf plate 54 where it will engage the handle 82 and/or the metallic ferrule 86 of the brush 80. The rib 78 has a height which is sufficient to raise the metallic ferrule 86 of the brush 80 at least slightly above the upper surface **54*a* of the shelf plate 54. A second raised rib 79 extends across the shelf plate 54 at a location that is sufficiently distal with respect to both the stop plate 60 and the first rib 78 to assure engagement with the handle 82 of the brush 80 such that both the handle 82 and the ferrule 86 will be maintained upwardly of any paint on the upper surface 54*a* of the plate 54. In addition, the first and second ribs 78 and 79 provide a means of supporting a sufficient portion of the brush 80 to encourage any paint within the bristles 84 of the brush 80 to flow outwardly from the bristles 84 toward the forward end of the receptacle 62 rather than rearwardly toward the ferrule 86 or the handle 82**.

In order to assist in preventing the paintbrush 80 from falling out of the caddy 50 either or both of two separate features may be employed. Lateral stability, for example, may be assured by extending the side walls 56 and 58 along a portion of the distal edge 88 of the shelf plate 54 to create a notch 89 located in proximity to the second raised rib 79 and into which the handle 82 may be received to prevent undesirable lateral movement thereof. A second feature may also be employed to prevent the bristles 84 from being flipped out of the cavity 82, as by the inadvertent application of a downwardly directed force on the handle 82. Specifically, the stop plate 60 may curve, or extend, at an acute angle $\alpha_3$ with respect to the shelf plate 54. The stop plate 60 may also be characterized by a downwardly turned lip 68 which extends laterally across the width of the stop plate 60 from one side wall 56 to the other side wall 58. As illustrated in FIG. 3, the configuration of the lip 68 may be such as to tend to preclude the paintbrush 80 from being inadvertently flipped rearwardly out of the cavity 62 in the brush caddy 50.

Referring now also to FIG. 5, a clamping means 70 on the brush caddy 50 will interact with either of the desired side walls 14 or the end wall 16 of the paint tray 12. The specific configuration of the clamping means 70 is not critical, but it will preferably be presented from either the rear surface 52*a* of the apron 52 or the under surface 54*b* of the shelf plate 54. One form thereof, may comprises a spring end 72 which is attached to a base plate 74. The base plate 74 may be affixed to the under surface 54*b* of the shelf plate 54, as by a pair of fasteners 76. The fasteners 76 may comprise screws, rivets or other suitable devices, and the spring end 72 may be made as an integral part of the base plate 74. The clamping means 70 is positioned forwardly on the under surface 54*b* such that the spring end 72 is in close proximity to, or in contacting engagement with, the rearwardly directed surface 52*a* of the apron 52. When the spring end 72 is urged rearwardly in the direction of arrow $A_1$ by inserting one of the walls 14 or 16 of the tray 12 between the spring end 72 and the apron 52, the spring end 72 is forcefully biased against the selected wall 14 or 16 (wall 16 as depicted). As should now be apparent, the rolled crimp 24 will prevent the spring end 72 from inadvertently moving upwardly and off the selected side wall 14 or the end wall 16.

FIG. 6 illustrates an alternative clamping means 90 in side elevation, and the alternative clamping means 90 comprises a spring end 92 which is hinged to a bifurcated bracket 94 via a hinge pin 96. The bracket 94 may be fastened to the under surface 54*b* of the shelf plate 54 by way of various type fasteners, or it may be secured thereto with a suitable adhesive. The spring end 92 is biased by a coil spring 100 having one end acting against the spring end 92 while the opposite end is reacting against the bracket 94. Accordingly, when the spring end 92 is urged in the direction of arrow $A_2$ it effects a forceful engagement with a paint container wall, such as the end wall 16 (shown in phantom) positioned between it and the apron 52.

The width "w" of a clamping means 70 or 90 may vary, but preferably such width is sufficient for stabilized clamping of the brush caddy 50 onto one of the side walls 14 or the end wall 16 of a paint tray 12. As shown in FIG. 4, the width "w" may be about one-third the width of the apron 52. Alternatively, the width "w" may be equal to the total width of the apron 52 which may or may not also be the total width of the brush caddy 50. Clearly, the width of the clamping means 70 or 90 may be varied in different ways. Suffice to say that a sufficient width for either of the clamping means 70 or 90 should be used to insure a stabilized clamping of the brush caddy 50 onto a paint container.

The concepts of the paintbrush caddy 50 heretofore described may also be incorporated in a relatively spartan structural arrangement. For example, the alternative paintbrush caddy 150 depicted in FIGS. 7 may also employ an apron 152 that extends downwardly from the forward end of a shelf plate 154. As such, the shelf plate 154 extends rearwardly from the apron 152 for a distance sufficient to support a standard length paintbrush 80, but the shelf plate 154 preferably terminates short of the length of a standard paintbrush. In this way, a paintbrush 80 carried by the caddy 150 will have its handle 82 extend beyond the rearward end of the shelf plate 154 such that a painter may easily grab the handle 82 without any interference from any part of the caddy 150.

The apron 152 merges with a crenelated stop plate 160 which extends above the upper surface 154*a* of the shelf plate 154. The stop plate 160 may be integral with, or be connected to, the lateral edge portions of the shelf plate 154 by virtue of a pair of side walls 156 and 158. The combination of the shelf plate 154, the crenelated stop plate 160 and the side walls 156 and 158 in the embodiment depicted in FIGS. 7 define a receptacle 162 into which a paintbrush 80 may be inserted for temporary stowage.

The crenelations in the stop plate 160 constitute a plurality of drain apertures 166 which extend through the stop plate 160 and into the receptacle 162. The base 167 of each drain aperture 166 is disposed at the same level as the upper surface 154*a* of the shelf plate 154. The bristles 84 of a paintbrush 80 received within the receptacle 162 slide against the stop plate 160—i.e., the vertical grill portions 164 disposed between the drain apertures 166—to maintain the brush 80 within the receptacle 162.

As in the previously described embodiment, the apron 152 is disposed at a substantially obtuse angle $\alpha_1$ with respect to the shelf plate 154. This results in the shelf plate 154 being positioned at an acute angle $\alpha_2$ with respect to a horizontal frame of reference, which will normally be parallel to the surface 26 upon which the paint tray 12 will rest when it is being used. Accordingly, when a paintbrush 80 is inserted into the receptacle 162, the bristles 84 will be inclined downwardly toward the forward end of the receptacle 162. In this orientation any excess paint contained within the bristles 84 of the brush 80 will flow, via gravity, along the upper surface 154*a* of the shelf plate 154, through the drain apertures 166 and downwardly along the apron 154 and thereafter into the well 18 of the paint tray 12.

To further facilitate paint drainage from the paintbrush 80 and to preclude the paint from flowing toward the handle 82 of the brush 80, even when the caddy 150 is being moved, the shelf plate 154 may present a first, raised rib 178 which extends across the width of the shelf plate 154 medially between the shelf plate 154 and the distal edge 188 of the shelf plate 154. The rib 178 may be formed as part of the shelf plate 154, and it is preferably positioned at a point along the length of the shelf plate 154 where it will engage the handle 82 and/or the metallic ferrule 86 of the brush 80. The rib 178 has a height which is sufficient to raise the metallic ferrule 86 of the brush 80 at least slightly above the upper surface 154*a* of the shelf plate 154. In this manner, paint within the bristles 84 of the brush will be encouraged to flow outwardly from the bristles 84 toward the forward end of the receptacle 162 rather than rearwardly toward the ferrule 86 or the handle 82.

A second raised rib 179 extends across the distal edge 188 of the shelf plate 154 at a location that is sufficiently distal with respect to both the stop plate 160 and the first rib 178 to assure engagement with the handle 82 of the brush 80 such that neither the handle 82 nor the ferrule 86 will readily contact the upper surface 154*a* of the shelf plate 154 and thus be maintained upwardly of any paint thereon.

Lateral stability of the paintbrush 80 within the receptacle 162, for example, may be assured by extending the side walls 156 and 158 along a portion of the distal edge 188 of the shelf plate 154 to create a notch 189 which may be located in proximity to the second raised rib 179 and into which the handle 82 may be received to prevent undesirable lateral movement thereof.

With continued reference to FIG. 7, a clamping means 170 may be provided for the brush caddy 150 which will interact with either of the desired side walls 14 or the end wall 16 of the paint tray 12. Here, too, the specific configuration of the clamping means 170 is not critical, and one form thereof, may constitute a generally S-shaped configuration wherein one end 171 of a flat base leg 173 is conjoined with one end 175 of a spring portion 177 such that the spring portion 177 lies in generally parallel disposition relative to the base leg 173. The spring portion 177 extends between the base leg 173 and a gripper arm 179 to complete the S-shaped configuration of the alternative clamping means 170.

The base leg 173 of the clamping means 170 may be secured to the apron 152 of the caddy 150 by fastening means in the nature of those heretofore described. Alternatively, the base leg 173 may be received within a pocket (not shown) formed in the rear face 152*a* of the apron 152, or the base leg 173 and the opposed spring portion 177 may effect a spring biased clamping arrangement whereby to secure the apron 152 effectively therebetween. The disposition of, and the connection between, the base leg 173 and the spring portion 177 may readily effect this result.

The spring portion 177 and the gripper arm 179 may similarly effect a clamping arrangement whereby to secure one wall of a paint container therebetween. As such, the clamping means 170 may readily be mounted on either side wall 14 or the end wall 16 of the paint tray 12.

It will, of course, be recognized that a paintbrush caddy embodying the present invention may be fabricated from various type materials including wood, metal, and/or plastic. Preferably, the brush caddy 50 or 150 will be made from a suitable plastic material which exhibits the desired durability and is lightweight. Should the caddy 50 or 150 be made from a plastic material, it is anticipated that it may be made as a single molded unit, although the clamping means may be separately fabricated and then fastened to the caddy. Alternatively, the plastic brush caddy may be made of multiple, individually molded pieces which are conjoined to form the unitary single structure. The manner and/or method of its manufacture is not, and should not, be considered as a limitation on the invention.

It will also be recognized that a paintbrush caddy embodying the concepts of the present invention may be made in various widths in order to accommodate the multiple widths of brushes presently available in the market place. For example, the brush caddy may be made in a medium width of about 3.5 inches (8.9 cm) to accommodate brushes up to and including three inches in width. Alternatively, the brush caddy may be made in a width of about 6.5 inches (16.5 cm) to accommodate even wider brushes, say up to and including those six inches in width. Moreover, the number of drain apertures 66 or 166 may also vary, and that variation will depend on the total width of the brush caddy. While the drawings illustrate a brush caddy having three drain apertures 66 or 166 for the return of paint to the paint container, a caddy embodying the concepts of the present invention may utilize only one or two drain apertures, or as many more as one wishes to include in the forward, upwardly extending stop plate 60 or 160. Obviously, however, the stop plate must be configured to retain a paintbrush 80 in the intended position within the receptacle 62 or 162.

As may now be apparent, the paintbrush caddy embodying the present invention may be mounted to a wall on any type of paint container. While the drawings illustrate mounting the caddy to any wall of a well known and recognized roller brush paint tray 12, it may as well be mounted to any other type of paint container such as, for example, a conventional one-gallon paint can. The present invention, therefore, is not limited to the type of paint container to which it may be mounted.

As should now also be apparent, the present invention not only discloses a paintbrush caddy which facilitates temporary stowage for a paintbrush that is being intermittently used on a job but also accomplishes the other objects of the invention.

We claim:

1. A paintbrush caddy adapted for use with a paint container having at least one vertically disposed wall, the caddy comprising:

a shelf plate having an upper surface which extends between a forward and a rearward end portion;

an apron extending downwardly from the forward end portion of said shelf plate;

a stop plate extending upwardly from the forward end portion of said shelf plate;

a receptacle defined between said shelf plate and said stop plate;

at least one drain aperture penetrating said stop plate; and, a clamping means to interact with the wall of a paint container.

2. A paintbrush caddy, as set forth in claim 1, wherein:

the upper surface of said shelf plate is adapted to support a paintbrush such that the bristles of the brush are positioned forwardly within the receptacle and excess paint contained within the bristles may flow toward the forward end of said shelf plate and through said drain apertures to be returned to the paint container.

3. A paintbrush caddy, as set forth in claim 2, wherein:

a rib extends transversely of said upper surface to raise the handle of a paintbrush supported thereon above the level of said upper surface.

4. A paintbrush caddy, as set forth in claim 3, wherein:

a pair of side members interconnect between said shelf plate and said stop plate further to define the receptacle provided therebetween.

5. A paintbrush caddy, as set forth in claim 2, wherein:

said shelf plate is disposed at an obtuse angle with respect to said apron.

6. A paintbrush caddy, as set forth in claim 5, wherein:

said stop plate is disposed at an acute angle with respect to said shelf plate.

7. A paintbrush caddy, as set forth in claim 1, wherein:

the longitudinal extent of said shelf plate is less than the overall length of the paintbrush to be supported thereon.

8. A paintbrush caddy, as set forth in claim 1, wherein said clamping means comprises:

a base plate;

fastening means securing said base plate to the under surface of said shelf plate; and, a spring end affixed to a said base plate.

9. A paintbrush caddy, as set forth in claim 1, wherein said clamping means comprises:

a base plate;

fastening means to secure said base plate to the under surface of said shelf plate;

a spring end connected to a base plate via a hinge pin such that said spring end will rotate about said hinge pin; and, a coil spring having one end acting against said spring end and the opposite end reacting against said shelf plate.

10. A paintbrush caddy, as set forth in claim 1, wherein said clamping means comprises:

a base;

a gripper arm; and, a spring portion interconnecting said base and said gripper arm in a generally S-shaped configuration.

11. A paintbrush caddy, as set forth in claim 10, wherein:

said spring portion biasingly urges said gripper arm such that the wall of a paint container may be grippingly secured therebetween.

12. A paintbrush caddy, as set forth in claim 11, wherein:

said spring portion biases said base leg such that said apron may be securely gripped therebetween.

* * * * *